US005751118A

United States Patent [19]

Mortimer

[11] Patent Number: 5,751,118

[45] Date of Patent: May 12, 1998

[54] UNIVERSAL INPUT DIMMER INTERFACE

[75] Inventor: George W. Mortimer, Fort Wayne, Ind.

[73] Assignee: Magnetek, Nashville, Tenn.

[21] Appl. No.: 499,771

[22] Filed: Jul. 7, 1995

[51] Int. Cl.[6] ..... H05B 37/02

[52] U.S. Cl. ..... 315/291; 315/DIG. 4; 315/324; 363/78; 363/26; 363/142; 307/21

[58] Field of Search ..... 327/333, 403, 327/514; 315/DIG. 4, 324, 291, 308; 323/902, 909; 307/21, 22, 24, 25, 26, 29, 31, 80, 81, 82, 85, 86, 116, 125, 127, 128; 363/74, 78, 79, 142, 26

[56] References Cited

U.S. PATENT DOCUMENTS

| | | | |
|---|---|---|---|
| 4,740,883 | 4/1988 | McCollum | 307/26 X |
| 4,889,999 | 12/1989 | Rowen | 307/31 |
| 5,003,230 | 3/1991 | Wong et al. | 315/279 |
| 5,089,751 | 2/1992 | Wong et al. | 315/279 |
| 5,198,726 | 3/1993 | Van Meurs et al. | 315/224 |
| 5,204,587 | 4/1993 | Mortimer et al. | 315/308 |
| 5,245,220 | 9/1993 | Lee | 307/80 |

OTHER PUBLICATIONS

Advance Transformer Co. Mark 7 Series Dimming Ballast Brochure.

Carlson, Luminoptics Single Zone Controller Users $ Manval, Jul. 5, 1984.

*Primary Examiner*—Robert Pascal
*Assistant Examiner*—Arnold Kinkead
*Attorney, Agent, or Firm*—Mark P. Bourgeois

[57] ABSTRACT

A universal input dimming circuit for coupling an isolated external control signal into a variable output power supply, particularly those used for driving fluorescent lamps. Circuitry is incorporated which allows to discriminate between a DC control voltage or a relatively low-frequency pulsewidth-modulated signal using the same pair of input leads. By appropriate conditioning and waveshaping, the circuit produces a pulsewidth-modulated output which is then coupled across an isolation boundary and then demodulated to provide a command signal to the dimming ballast.

12 Claims, 7 Drawing Sheets

UNIVERSAL INPUT DIMMER INTERFACE

BACKGROUND OF THE INVENTION

This invention relates to circuits for coupling an isolated external control signal into a variable output power supply, particularly those used for driving fluorescent lamps. Typical control schemes for fluorescent dimming fall into two types: those using a DC control voltage of 0 to 10 VDC to adjust the ballast output, and those which use a relatively low-frequency pulsewidth-modulated signal of 12 volts or thereabouts peak voltage. An example of the first is the system employed by the Advance Transformer Co.'s Mark VII series, the Lithonia Optimax control system, and other building and lighting controls products. The latter is typified by the Luminoptics LMCS system which is in limited use on the East Coast, as well as systems being proposed by the IEC Dimming Controls Council. The basic incompatibility between these two systems is that the pulsewidth-modulated system uses the absence of a signal as a "full-ON" command and decreases the output with increased pulse width, while the DC scheme uses the absence of signal to indicate a low output request and increases the output with increasing signal amplitude. This eliminates the possibility of using a simple low-pass filter to convert the PWM signal to DC. In addition, some schemes, such as the proposed IEC dimming control standard, use a non-linear transfer function for the control-to-output gain.

The present invention proposes a method for selecting one of two signal paths for the control input, depending on whether it is a DC or PWM signal. By appropriate conditioning and waveshaping, the circuit produces a pulsewidth-modulated output which is then applied to a photocoupler in order to provide galvanic isolation between the control interface and the power circuitry. The output of the photocoupler is then demodulated and used as the command signal provided to the dimming ballast.

SUMMARY

An object of the invention is to provide a low cost universal input dimmer interface circuit that can accept a variety of input signals and generate the proper control signal for a dimming ballast.

A universal input dimmer interface circuit adapted for receiving a plurality of input waveforms comprising:

direct current modulator means for providing as an output a first pulse train, the first pulse train having pulse widths proportional to the magnitude of a direct current signal;

pulse width conditioning means for inverting a pulse width modulated signal, the pulse width conditioning means providing as an output a second pulse train;

detect means for providing a disabling signal in response to the input waveforms such that either the direct current modulator means or the pulse width conditioning means are selected to be disabled; and demodulator means for converting the first pulse train and the second pulse train into a control signal, whereby the control signal is generated from the input waveforms.

DESCRIPTION OF SPECIFIC EMBODIMENTS

Figure 1:
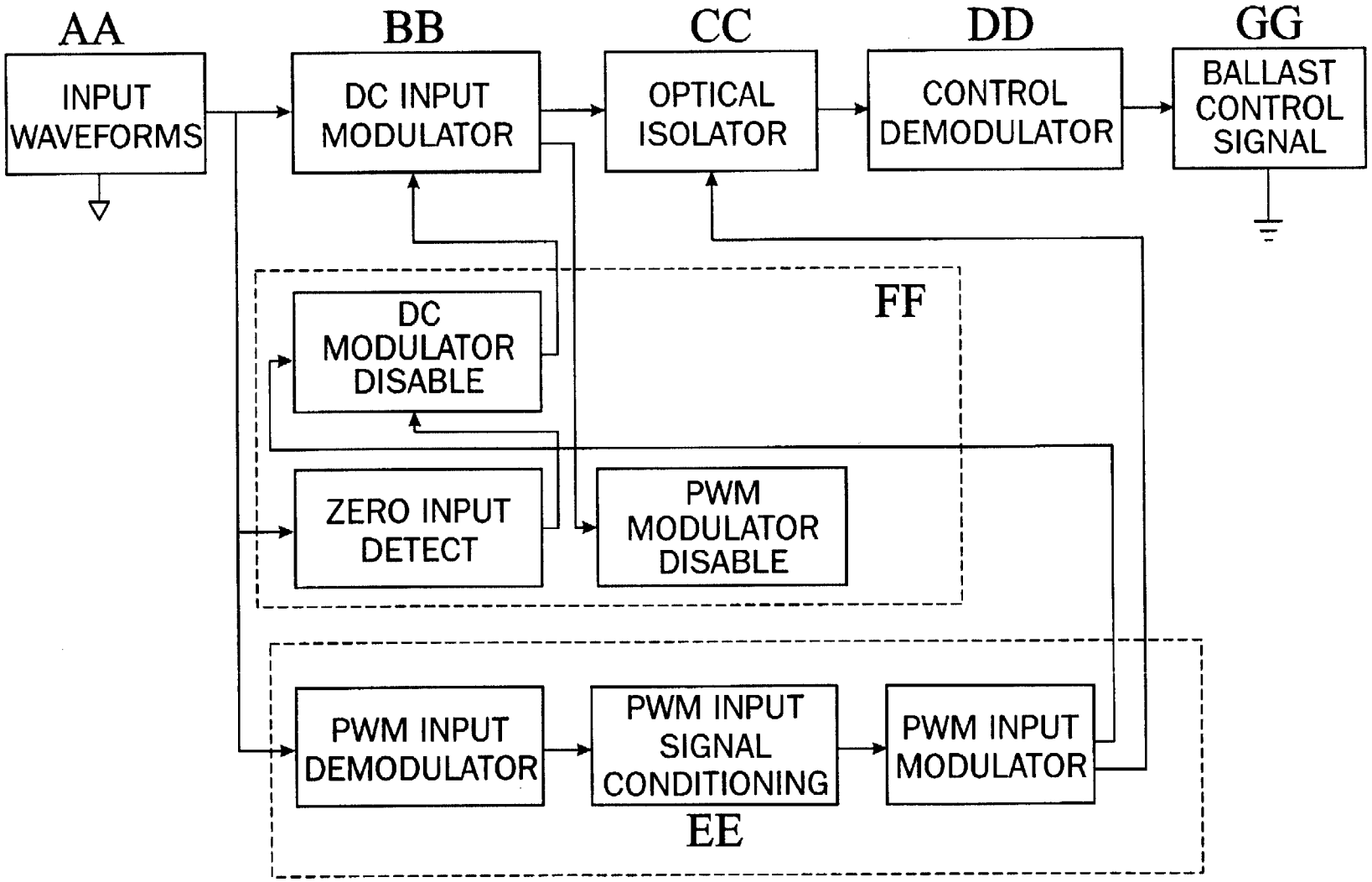
FIG. 1 shows a block diagram of the proposed control circuit.

FIG. 1 contains a block diagram of a preferred embodiment of the invention. Input waveforms from the dimming controller AA is a two-wire signal which can be either a DC level or a pulsewidth-modulated signal. The dimming control signal is first fed into a conventional pulsewidth modulator (PWM) circuit BB where, if the signal was originally a DC level, it is converted into a series of pulses whose width is proportional to the DC level of the input signal. The first pulse train thus generated is applied to the input of the isolation block CC, which is generally an optical isolator, although a pulse transformer can be used. Then the output is demodulated by demodulator DD, which provides a ballast control signal GG to the lamp ballast.

The input signal is also applied to a PWM conditioning block EE, which inverts the input (if it was originally a PWM signal) and outputs a second pulse train. The second pulse train thus generated is applied to the input of the isolation block CC, which is generally an optical isolator, although a pulse transformer can be used. Then the output is demodulated by demodulator DD, which provides a ballast control signal GG to the lamp ballast.

Finally, the input signal is also applied to detector circuit FF, which determines if the signal is a PWM signal or a DC level, and enables the appropriate signal path while disabling the other path. While other multiple-input control input schemes have used common isolation devices and demodulators, they have relied on completely separate input paths for DC and PWM inputs, thus requiring selection to be made by appropriate termination of the unused signal input. The novelty of this invention is that the use of the pulsewidth detect circuitry makes this effort unnecessary.

Figure 2:
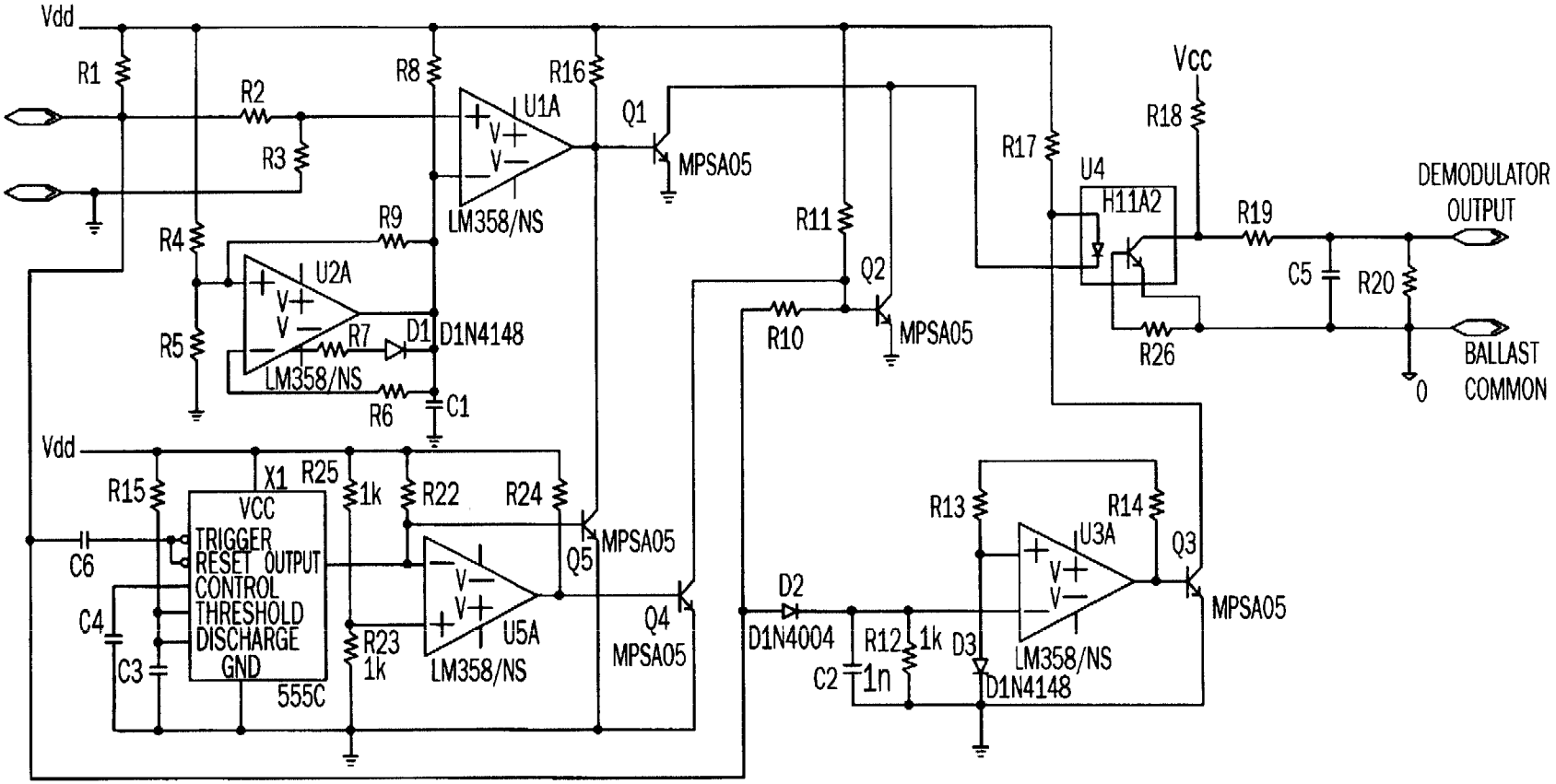
FIG. 2 shows a detailed schematic of one proposed embodiment of the invention.

FIG. 2 contains a schematic of a first embodiment of the proposed invention. Input line Vin is first tied to an internal DC bias source through resistor R1, which is selected to provide an appropriate source of current for passive dimming controllers. The signal is then applied to comparator U1A through resistor divider R2 and R3, which scale the input signal for comparison with the triangle wave generated by sawtooth generator made up of comparator U2A, resistors R4 through R9, capacitor Cl, and diode D1. The output of U1A is then applied to transistor Q1, which sinks current through resistor R17 and the photodiode of optoisolator U4A only when U1A's output is HIGH. The phototransistor in U4A then pulls the junction of resistors R18 and R19 LOW when the photodiode is on. R18 is also connected to the internal reference of the ballast control circuit, which allows the R18/R19 node to be pulled HIGH when the phototransistor is off, thus creating a duplicate PWM signal at that node to the signal presented to the photodiode. By using the optocoupler in an on/off manner, problems with degradation of optocoupler current transfer ratio are eliminated. The only requirement is to select the diode current (via the value of R17) to ensure there is adequate current to fully saturate the phototransistor. Finally, the PWM circuit at the R18/R19 node is demodulated by a low-pass filter made up of resistors R19 and R20 and capacitor C5. This creates a DC level which is then applied to the ballast control circuit.

Input signal Vin is also applied directly to the base of transistor Q2, which inverts the PWM signal and then is connected to Q1 in a "wire-OR" configuration, thus allowing either of the two transistors to activate optocoupler U4A.

Monostable multivibrator X1 is set up as a retriggerable switch. Input pulses are applied to both the RESET and TRIGGER pins of X1, thus causing the output to go HIGH, turning transistor Q5 ON and disabling the output of U1A. The duration of the timer output is set to be longer than the period of the PWM input signal, so that as long as another pulse arrives before the timer cycle is completed the timer will be retriggered and the output of X1 will remain HIGH. In the absence of input pulses to X1 (as would occur with a DC input signal), X1's output will remain LOW, thus keeping Q5 OFF and not allowing it to disable the DC input signal path. This low output is also inverted by comparator U5A, which then provides a HIGH signal to transistor Q4. This signal shorts out the base of Q2, thus disabling the PWM input signal path.

Since a zero-pulsewidth PWM signal, equivalent to a fully ON command, has no AC component to be detected by the PWM circuit, the detect circuit could be fooled into not disabling the DC command signal path, and providing a zero-input command to the isolator and demodulator (thus shutting off the ballast). To prevent this, the input signal Vin is also applied to threshold detector U3A. If the DC level of the input signal is below the threshold set by resistor R13 and diode D3, the comparator U3A turns ON transistor Q3, which shunts the drive current away from the photodiode of U4A. This results in a fully-ON signal at the input to demodulator R19/R20/C5, and a HIGH command signal applied to the ballast control input. When the DC level is above the threshold, or when the PWM signal is in the HIGH state, Q3 is disabled and the photocoupler operates normally.

Figure 3:
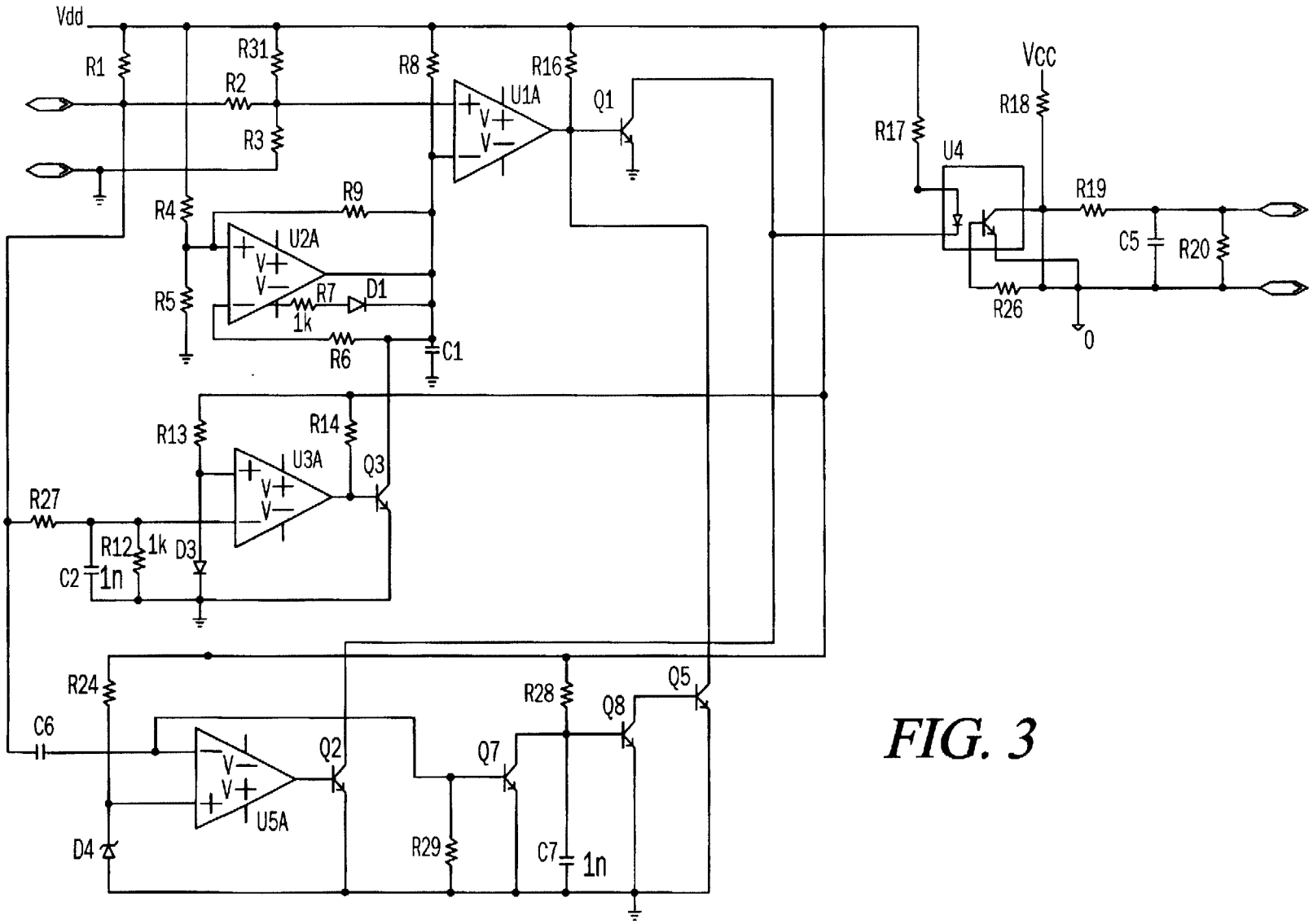
FIG. 3 shows an alternate implementation of the invention with a simplified PWM signal detection method.

A simplified method of implementing the PWM detect and input pulsewidth interface is shown in FIG. 3. The signal path for the DC input case is the same as that described above. However, the PWM detect is accomplished by capacitively coupling the Vin signal to the base of transistor Q7 through capacitor C6. Q7 then discharges capacitor C7, thus holding Q8 OFF and allowing R29 to turn Q5 ON, disabling the DC input signal path as in the previous example. If there is no PWM component at Vin, no signal can be passed through the capacitor, Q7 remains OFF, thus allowing Q8 to be ON and Q2 is held OFF so as to not interfere with the DC input path.

Since capacitor C6 only allows an AC signal through, it also serves as a method for disabling the PWM input. C6 is directly connected to the input of comparator U5A which compares it to the threshold level set by resistor R24 and Zener diode D4. The comparator serves as an inverter in a manner similar to the circuit of FIG. 2, and its output is connected to transistor Q2 and "wire-OR'ed" to the DC signal path in the same manner as the previous circuit. Since the PWM signal only (no DC component) is available at the input of U5A, the PWM signal path is automatically disabled for the DC input condition.

In this implementation, the zero-input override circuit is provided by using the circuit as defined in the previous implementation; however, instead of cutting off the bias to the photocoupler it is connected to the inverting input of modulator comparator Q1. When the circuit detects a zero-input condition, it pulls the sawtooth input of the comparator LOW. A small amount of voltage is summed into the non-inverting input of U1A via resistor R31, thus ensuring that the non-inverting node will always be above zero. The comparator then behaves as if it sees a fully-ON DC input, and drives the rest of the signal path to the fully ON condition (which is the desired result).

Certain embodiments of 12-volt PWM control schemes switch the control line using a single ON/OFF switch in series with the bias source, thus switching the line from +12VDC to a high-impedance (open) condition. By judicious selection of the threshold level (R24 and D5), the detector can be set to not trip until the input reaches a level greater than that obtained by an open circuit and input divider R1, R2, and R3.

Figure 4:
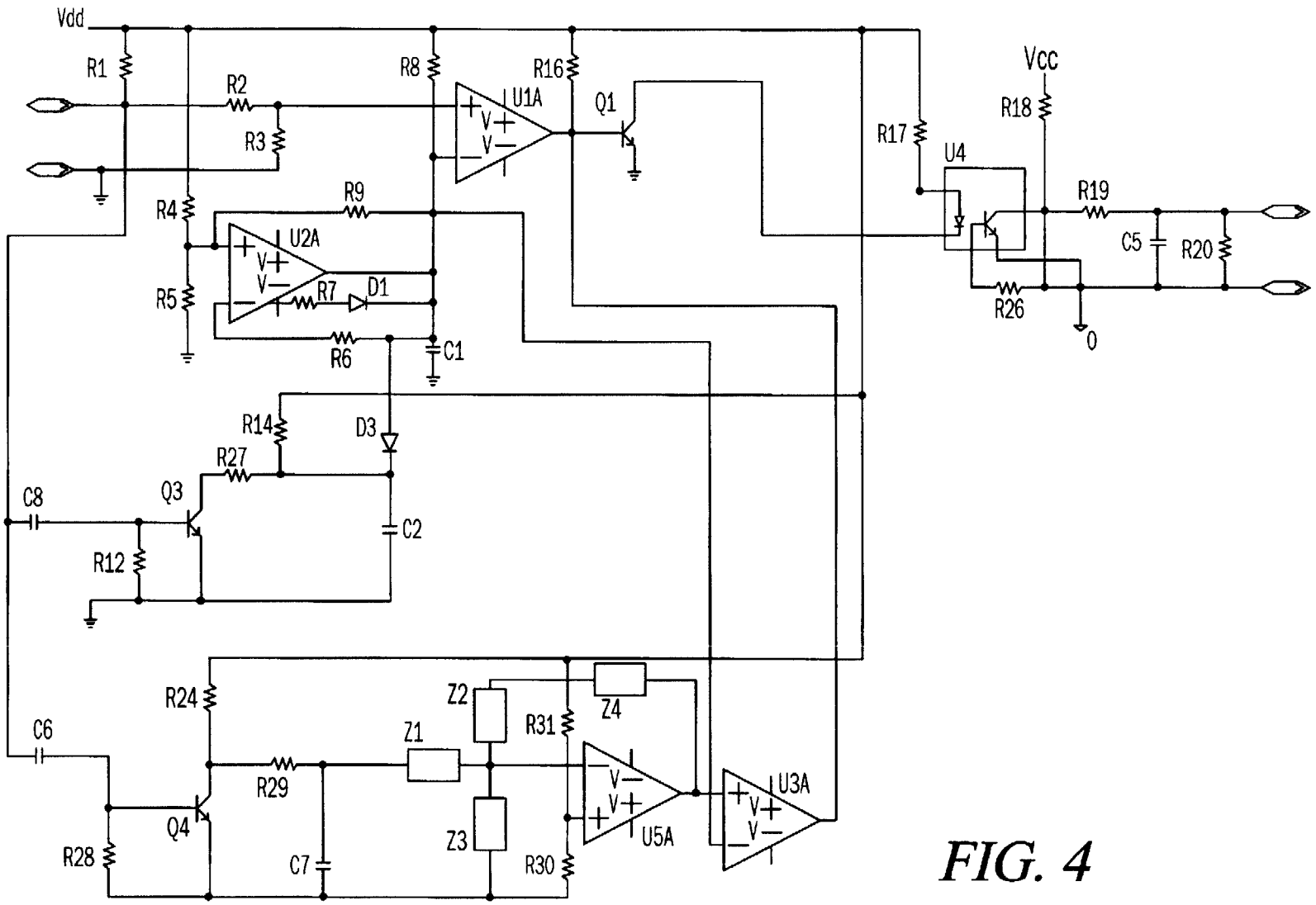
FIG. 4 shows an alternate implementation of the invention which includes gain profiling of the PWM input signal.
Figure 5:
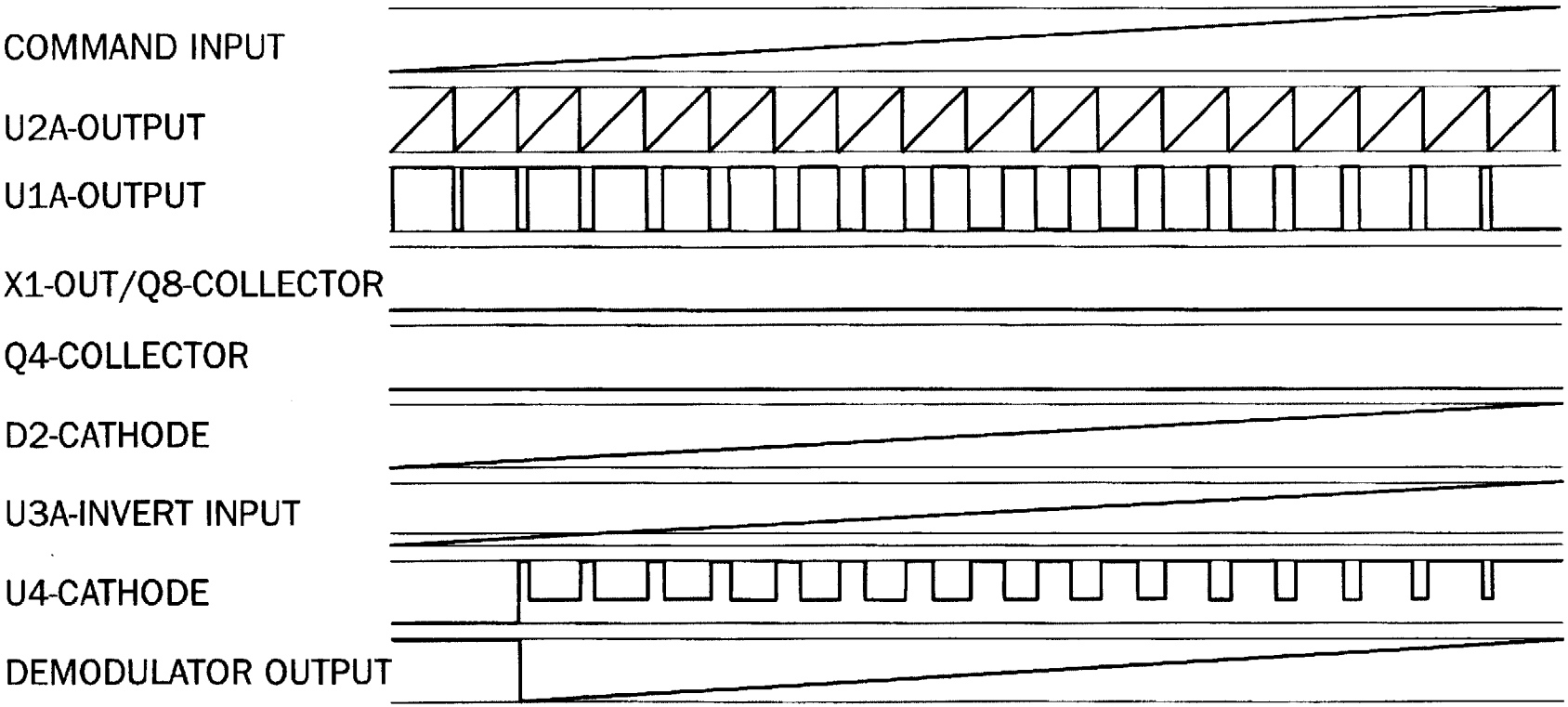
FIG. 5 shows the waveforms generated by the circuit in DC input mode.
Figure 6:
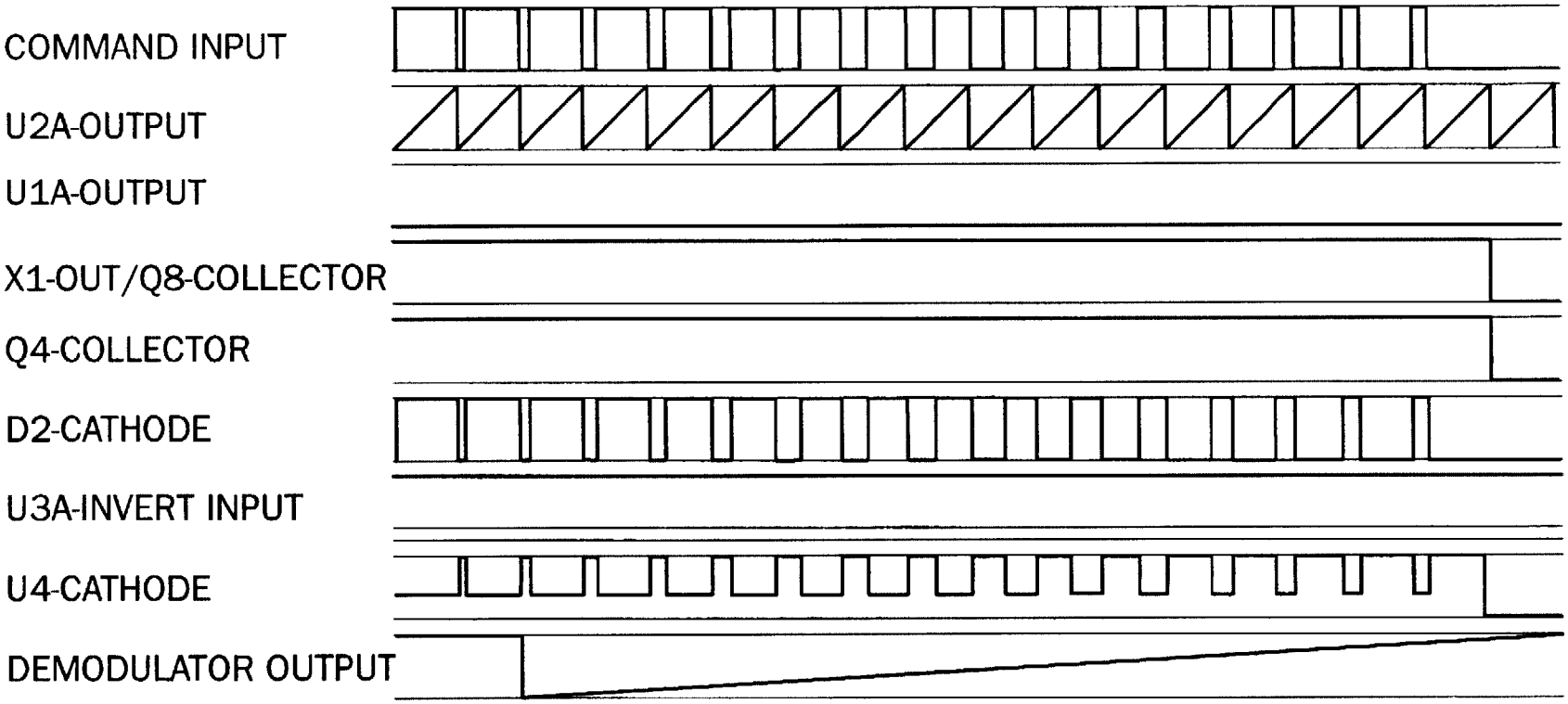
FIG. 6 shows the waveforms generated by the circuit in PWM input mode.

One deficiency in the previous implementations is that for both the DC and PWM cases, the transfer function between the input signal and the output command is essentially linear. While this may not be a problem, there have been several proposals made in the international community to use a transfer function which is other than linear (specifically a logarithmic function) for pulsewidth modulated dimming control systems. In order to accommodate these proposals, a third embodiment of this invention is shown in FIG. 4. In this embodiment, the DC signal path and PWM disable circuits are the same as those used in FIG. 3. For the PWM input signal path, Vin is again capacitively coupled by C8 to an inverting circuit, this time made up of resistor R32 and transistor Q9. The inverted circuit is demodulated by resistors R33 and R34 and capacitor C10 in a manner similar to that used on the optocoupler output in order to provide a DC signal. The output is then fed to operational amplifier U6, which profiles the transfer function to the desired function by appropriate selection of feedback networks Z1, Z2, Z3, and Z4. The output of U6 is then fed to comparator U7, which compares that signal to the triangle wave generated by U2A to re-modulate the signal in a manner similar to that used for the DC input path. The outputs of U7 and U1A are then "wire-OR'ed" together, and drive Q1, the optoisolator, and the demodulation network as described previously.

Figure 7:
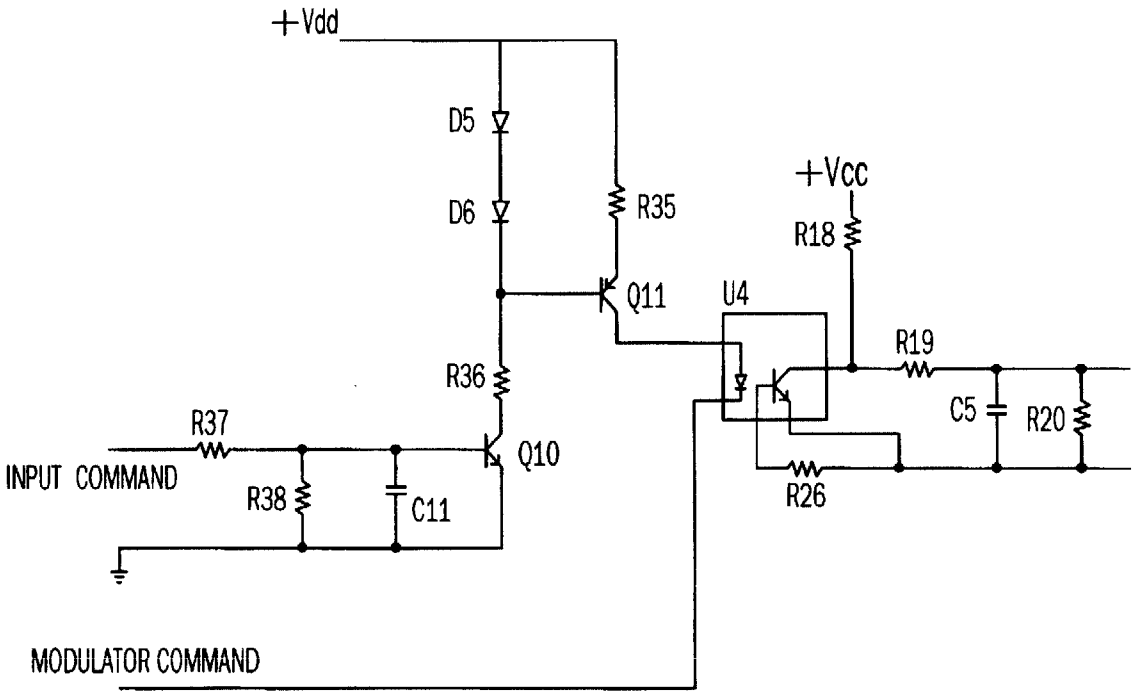
FIG. 7 shows an alternate embodiment of the circuit which includes a method of forcing the output to a fully ON command in the event of a fault in the control wiring.

An alternate circuit for combining the PWM and DC command signal paths is shown in FIG. 7. This alternate implementation, while providing a constant-current source for the optocoupler in order to optimize its performance, also has the advantage of ensuring a "fail-safe" mode of operation which causes the lamps to go to full intensity in the event of a shorted or open control wire. In this circuit, the modulator output Q1 drives the cathode of the photodiode in U4A as in the previous circuits. The input command is applied to the base of transistor Q10 through resistor divider R37 and R38. As long as the input command is above 1.2 VDC, transistor Q10 will be ON and current will flow through diodes D5 and D6 and resistor R36. This will cause the base of PNP transistor Q11 to be 1.2 VDC (2 P-N junction voltage drops) below Vcc. The resultant voltage will allow current to flow into the base of Q11, turning it ON, and generating a voltage drop of 0.6 VDC from its emitter to its base. This leaves 0.6 VDC to be dropped across resistor R35, which then restricts the emitter current (which is approximately equal to the collector current) to 0.6/R35, or 6 milliamperes for a 100 ohm value of R35. This constant current then is used to drive the photodiode in U4A. For input commands less than 1.2 VDC, the current source is kept OFF, and no signal is applied to the photodiode. For PWM input operation, the current source is pulsed ON and OFF in sync with the input command, while its complement is applied to the modulator command via the signal processing networks described previously, thus allowing the photodiode to operate as before.

While the foregoing description includes detail which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

What is claimed is:

1. A universal input dimmer interface circuit adapted for receiving a plurality of input waveforms comprising:

direct current modulator means for providing as an output a first pulse train, the first pulse train having pulse widths proportional to the magnitude of a direct current signal;

a pulse width modulated input demodulator;

a pulse width modulated input signal conditioner connected to the output of the pulse width modulated input demodulator;

a pulse width modulated input modulator connected to the output of the pulse width modulated input signal conditioner such that a pulse width modulated signal is inverted, the pulse width modulated input modulator having as an output a second pulse train;

a zero input detector for providing a zero input signal in response to the input waveforms being absent;

direct current disabler means for disabling the direct current modulator means in response to a first disabling signal from the pulse width modulated input demodulator;

pulse width modulated disabler means for disabling the pulse width modulated input demodulator in response to a second disabling signal from the direct current modulator means; and demodulator means for converting either the first pulse train or the second pulse train into a control signal, the demodulator means converting the first pulse train into the control signal when the pulse width modulated input demodulator is disabled, the demodulator means converting the second pulse train into the control signal when the direct current modulator means is disabled, whereby the control signal is generated from the input waveforms.

2. A circuit according to claim 1, further comprising constant current source means for increasing the control signal in response to the input waveforms being shorted.

3. A universal input dimmer interface circuit adapted for receiving a plurality of input waveforms comprising:

a pair of input terminals for receiving the input waveforms;

current source means connected to the input terminals for providing a source of current in response to the input waveforms;

sawtooth generator means for providing a triangular waveshape;

comparator means for scaling and comparing the direct current waveform to the triangular waveshape in response to the input waveforms having a direct current input waveshape such that the direct current waveshape is converted into a pulse width modulated waveshape;

pulse width modulated inverter means for inverting the input waveforms in response to the input waveforms having a pulse width modulated input waveshape, the pulse width modulated inverter means having as an output a inverted pulse width modulated waveshape;

direct current disabler means for providing a first disabling signal to the comparator means for disabling the comparator means in response to the input waveforms having the pulse width modulated input waveshape;

pulse width modulated disabler means for providing a second disabling signal to the pulse width modulated inverter means in response to the input waveforms having the direct current waveshape;

a zero input detector for providing a zero input signal in response to the input waveforms being absent;

demodulator means for converting either the inverted pulse width modulated waveshape or the pulse width modulated waveshape into a control signal, the demodulator means converting the inverted pulse width modulated waveshape into the control signal when the comparator means is disabled, the demodulator means converting the pulse width modulated waveshape into the control signal when the pulse width modulated inverter means is disabled, whereby the control signal is generated from the input waveforms.

4. A circuit according to claim 3, further comprising means for isolation connected between the pulse width modulated inverter means and the demodulator means.

5. A circuit according to claim 3, further comprising means for isolation connected between the comparator means and the demodulator means.

6. A circuit according to claim 3, further comprising a ballast for driving a plurality of gas discharge lamps, the ballast having a ballast input terminal such that the control signal is applied to the ballast input terminal to control the gas discharge lamps.

7. A circuit according to claim 3, further comprising constant current source means for increasing the control signal in response to the input waveforms being shorted.

8. A circuit according to claim 3, further comprising transfer function means for generating the control signal in response to the input waveforms such that the control signal has a non-linear relationship to the input waveforms.

9. A universal input dimmer interface circuit adapted for receiving a plurality of input waveforms comprising:

direct current modulator means for providing as an output a first pulse train, the first pulse train having pulse widths proportional to the magnitude of a direct current signal;

pulse width conditioning means for inverting a pulse width modulated signal, the pulse width conditioning means providing as an output a second pulse train;

detect means for providing a disabling signal in response to the input waveforms such that either the direct current modulator means or the pulse width conditioning means are selected to be disabled;

demodulator means for converting either the first pulse train or the second pulse train into a control signal, the demodulator means converting the first pulse train into the control signal when the pulse width conditioning means is disabled, the demodulator means converting the second pulse train into the control signal when the direct current modulator means is disabled;

transfer function means for generating the control signal in response to the input waveforms such that the control signal has a non-linear relationship to the input waveforms.

10. A circuit according to claim 9, further comprising constant current source means for increasing the control signal in response to the input waveforms being shorted.

11. A circuit according to claim 9, in which the pulse width conditioning means comprises:

a pulse width modulated input demodulator;

a pulse width modulated input signal conditioner connected to an output of the pulse width modulated input demodulator; and a pulse width modulated input modulator connected to the output of the pulse width modulated input signal conditioner such that the pulse width modulated signal is inverted.

12. A circuit according to claim 9, in which the detect means comprises:

a zero input detector for providing a zero input signal in response to the input waveforms being absent;

direct current disabler means for disabling the direct current modulator means in response to a first disabling signal from a pulse width input modulator means; and pulse width modulated disabler means for disabling the pulse width input modulator means in response to a second disabling signal from the direct current modulator means.

* * * * *